US008397681B2

(12) United States Patent
Popadiuc et al.

(10) Patent No.: US 8,397,681 B2
(45) Date of Patent: Mar. 19, 2013

(54) EXPANSION TANK FOR VEHICLE COOLING SYSTEM

(75) Inventors: Peter Popadiuc, Bensenville, IL (US); Martin R. Zielke, Lockport, IL (US); Luis Carlos Cattani, Aurora, IL (US); Robert L. Rowells, Elmwood Park, IL (US); George L. Banta, III, Naperville, IL (US); Ernst Duerr, Willowbrook, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 165 days.

(21) Appl. No.: 12/552,808

(22) Filed: Sep. 2, 2009

(65) Prior Publication Data

US 2011/0048345 A1 Mar. 3, 2011

(51) Int. Cl.
*F01P 11/18* (2006.01)
*F01P 11/04* (2006.01)

(52) U.S. Cl. ..... 123/41.5; 123/41.01; 165/83; 138/30

(58) Field of Classification Search ..... 123/41.5, 123/41.15, 41.54, 184.21; 165/51, 134.1, 165/178, 83; 73/306; 138/26, 30; 222/386.5, 222/394

See application file for complete search history.

(56) References Cited

U.S. PATENT DOCUMENTS 2,039,587 A * 5/1936 Emanueli ..... 174/11 R
2,674,947 A * 4/1954 Kaiser ..... 417/44.1
2,720,270 A * 10/1955 Guise ..... 169/11
RE26,765 E * 1/1970 Holmes ..... 165/51
4,637,435 A * 1/1987 Chirdon ..... 138/30
4,836,168 A * 6/1989 Polster et al. ..... 123/41.5
5,449,956 A 9/1995 Williams
5,454,359 A 10/1995 Howell
5,836,269 A * 11/1998 Schneider ..... 123/41.1
5,970,928 A 10/1999 Smietanski
6,230,669 B1 * 5/2001 Evans ..... 123/41.5
6,588,377 B1 * 7/2003 Leary et al. ..... 122/19.1
8,065,980 B2 * 11/2011 Dahl et al. ..... 123/41.5
2010/0031901 A1 * 2/2010 Dahl et al. ..... 123/41.05

* cited by examiner

*Primary Examiner* — Lindsay Low
(74) *Attorney, Agent, or Firm* — Mark C. Bach; Jeffrey P. Calfa

(57) ABSTRACT

An expansion tank (10) for a vehicle cooling system (18) of an engine using a liquid coolant (16) includes a tank body (12) defining a first volume (V1) containing coolant (16), wherein the coolant defines a variable coolant elevation level (CEL) within the tank body. The tank body (12) also defines an upper volume (20) containing air. A bladder (14) is disposed in the tank body (12) and defines a second volume (V2) containing air. The bladder (14) includes a flexible membrane (36) actuated by an actuator (46). When the engine is stopped or is below a predetermined temperature, the flexible membrane (36) is moveable to a first position (FP) which lowers the coolant elevation level (CEL), and when the engine is started or reaches a predetermined temperature, the flexible membrane (36) is moveable to a second position (SP) which raises the coolant elevation level. A communicating line (38) is in fluid communication between the upper volume (20) and the second volume (V2) to fluidly communicate air therebetween.

9 Claims, 4 Drawing Sheets

EXPANSION TANK FOR VEHICLE COOLING SYSTEM

BACKGROUND

Embodiments described herein generally relate to vehicle cooling systems. More specifically, embodiments described herein relate to an expansion tank of a vehicle cooling system.

Typically an expansion tank of a vehicle cooling system is elevated relative to the other components of the cooling system such that the expansion tank can provide good coolant communicating and cooling system pressure. Communicating of the cooling system removes air or other gases that are trapped or generated in and by the cooling system through the vent lines connected to the tank. In some conventional cooling systems, the "low fluid level line" of the expansion tank is above the engine/vehicle coolant fill level line. Typically, an air volume in a conventional expansion tank is located entirely above the coolant level.

Due to engine packaging constraints, the low fluid level line of the expansion tank may not be located entirely above the coolant fill level line of the engine. In some cases, the expansion tank may be mounted at a relatively lower position where the level of coolant in the expansion tank may fall below the coolant fill level line of the engine.

SUMMARY OF THE INVENTION

An expansion tank for a vehicle cooling system of an engine using a liquid coolant includes a tank body defining a first volume containing coolant, where the coolant defines a variable coolant elevation level within the tank body. The tank body also defines an upper volume containing air. A bladder is disposed in the tank body and defines a second volume containing air. The bladder includes a flexible membrane actuated by an actuator. When the engine is stopped or is below a predetermined temperature, the flexible membrane is moveable to a first position which lowers the coolant elevation level, and when the engine is started or reaches a predetermined temperature, the flexible membrane is moveable to a second position which raises the coolant elevation level. A communicating line is in fluid communication between the upper volume and the second volume to fluidly communicate air therebetween.

DETAILED DESCRIPTION

Figure 1:
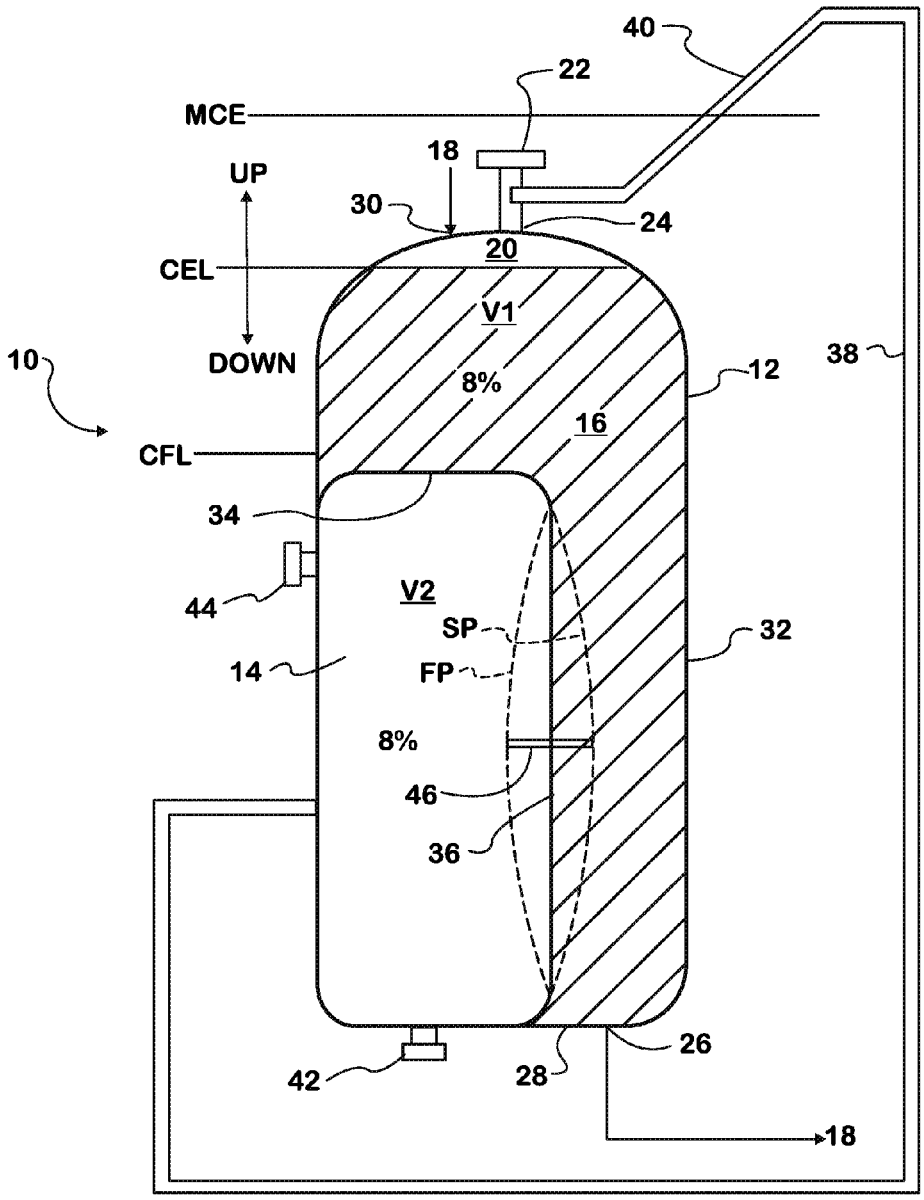
FIG. 1 is a schematic of an expansion tank for a vehicle cooling system.

Referring now to FIG. 1, a first embodiment of an expansion tank is indicated generally at 10 and has a tank body 12 with a first volume V1, and a bladder 14 disposed in the tank body 12 and having a second volume V2. The tank body 12 is generally cylindrical, however other shapes and configurations are possible. The first volume V1 is configured to receive liquid coolant 16 of a cooling system 18. The cooling system 18 is associated with an engine (not shown) that has a coolant fill level (CFL) and a maximum coolant elevation (MCE).

The coolant 16 inside the expansion tank 10 forms a coolant elevation level (CEL) within the tank body 12, and is dependent upon the amount of coolant and the thermal expansion of the coolant. As will be discussed below, the CEL is also dependent on the bladder 14. During operation of the cooling system 18, the CEL needs to be at least as high in elevation as the CFL of the vehicle.

The second volume V2 in the bladder 14 is configured to be filled with air and coolant vapors, collectively referred herein as "air". An upper volume 20 is located above the CEL and is also filled with air. The volume in the upper volume 20 and the second volume V2 is variable as the CEL moves up and down. The first volume V1 of coolant 16 is the total volume of the expansion tank 10, minus the second volume V2 of the bladder, and minus the upper volume 20. The first volume V1 of coolant 16 remains about the same. The volume of air contained in the second volume V2 and the upper volume 20 change relative to each other as the second volume V2 and the upper volume 20 are in fluid communication with each other.

A coolant cap 22 is disposed on a top surface 24 of the tank body 12. The coolant cap 22 is removable to fill the first volume V1 with coolant 16. A coolant output 26 is disposed at a bottom surface 28 of the tank body 12 to fluidly communicate coolant 16 to the cooling system 18. One or more coolant inputs 30 fluidly communicate the coolant 16 from the cooling system 18 to the tank body 12.

Typically, the air volume of a conventional tank is located entirely above the CEL. In the expansion tank 10, at least a portion of the second volume V2 of air is at a lower elevation than the CEL to displace the CEL in either the "Up" or "Down" direction indicated in FIG. 1.

At least a portion of the bladder 14 is located beneath the CEL. In the expansion tank 10, at least a portion of the bladder 14 is located at a lower half portion 32 of the tank body 12 such that air is located beneath the CEL. Further, at least a portion of the bladder 14 may be located at the bottom surface 28 of the tank body 12 so that air is at least as low in elevation as the CEL when any amount of coolant 16 is present in the tank body. It is also possible that the bladder 14 can be located at least partially remotely from the tank 10.

The bladder 14 may have at least one rigid wall 34 and at least one flexible membrane 36 that is operable to change the volume V2 of air. In the expansion tank 10, the bladder 14 is located at the bottom surface 28 of the tank body 12, the flexible membrane 36 has a generally vertical orientation, and the rigid wall 34 has a generally horizontal orientation, however other configurations of bladder 14 are possible. It should be appreciated that the bladder 14 can have a variety of locations and configurations that elevate the CEL.

Figure 3:
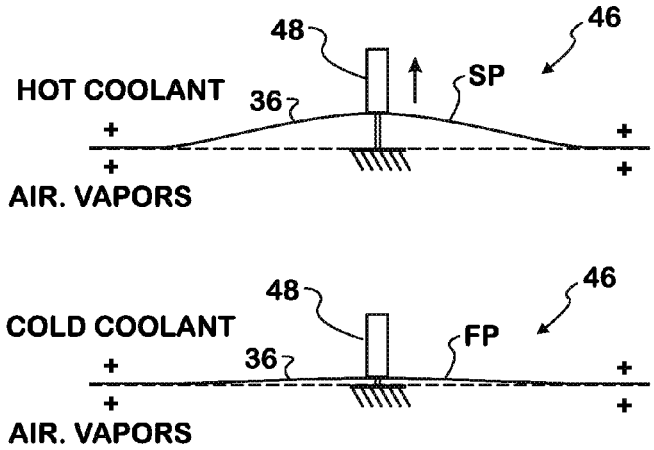
FIG. 3 is a schematic of a first temperature activated actuator.
Figure 4:
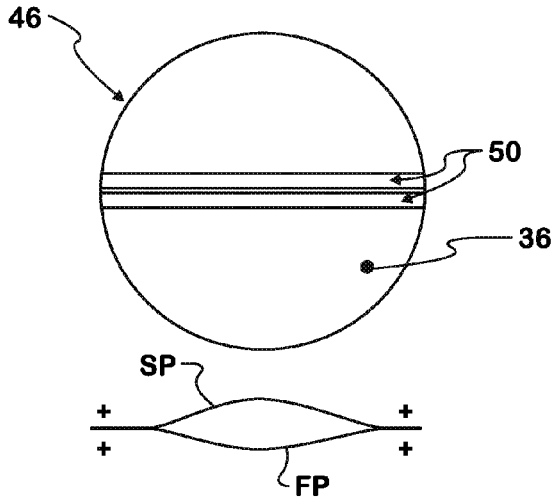
FIG. 4 is a schematic of a second temperature activated actuator.
Figure 5:
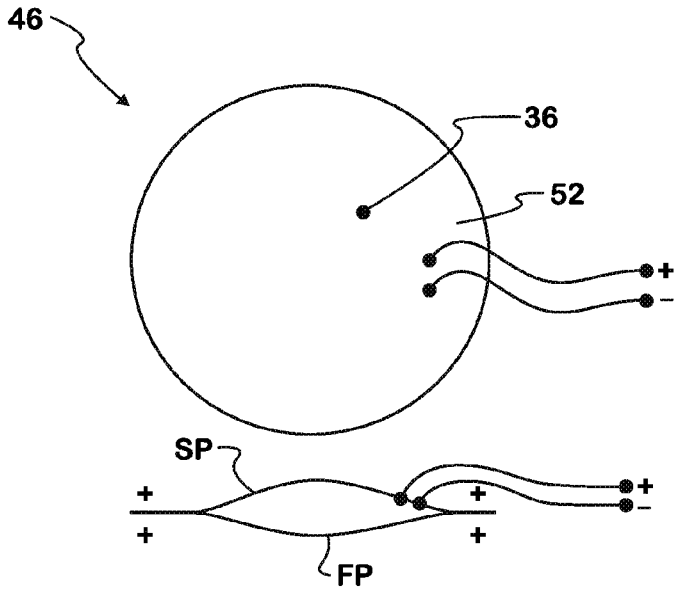
FIG. 5 is a schematic of an electrically activated actuator.

Referring to FIG. 3 to FIG. 5, an actuator 46 actuates the flexible membrane 36. The actuator 46 can be temperature activated, for example a t-stat (Vax) actuator 48 or a bimetallic actuator 50, or can be electrically actuated, for example an electro-active elastomer membrane 52. A mechanical actuator 46, such as a piston, may also actuate the flexible membrane 36.

When the engine is off, the membrane 36 has a first position, shown in dashed as FP, and having a generally convex shape with respect to the interior of the bladder 14. In position FP, the second volume V2 of air is decreased and the upper volume 20 of air is increased.

When the engine starts, or alternatively, when the engine starts and warms up to a predetermined temperature, or when the coolant 16 warms up to a predetermined temperature, and the actuator 46 actuates the membrane 36 pushing the membrane 36 to deflect to a second position, shown in dashed as SP, and having a generally concave shape with respect to the interior of the bladder 14. Alternatively, when a voltage is applied to the membrane 36 or when a mechanical force is applied to the membrane after the engine is started, the membrane deflects to the second position SP.

The change in the second volume V2 is about 4% to 8% of the total coolant volume of the vehicle cooling system, however other values are possible. In position SP, the second volume V2 of air is increased as the air from the top volume of the tank body 12 above the coolant surface CEL are pushed to the second volume V2. The CEL rises in the tank body 12, decreasing the upper volume 20 of air. Typically, the amount of coolant 16 of first volume V1 in the expansion tank 10 remains about the same, assuming the input from coolant input 30 into the tank body 12 and the output from coolant output 26 out of the tank body 12 are about the same.

When the membrane 36 is in position SP, the air from the upper volume 20 is displaced through a communicating line 38 where it is fluidly communicated to the second volume V2 of air. The communicating line 38 allows the CEL to rise in the "Up" direction indicated in FIG. 1 so that the CEL can be at or higher than the coolant fill level of the engine. When the membrane 36 returns to position FP, the air in the bladder 14 displaces through the communicating line 38 to the upper volume 20.

Should coolant 16 be fluidly communicated into the communicating line 38, the communicating line 38 may have an upward elevation portion 40 that can allow an additional increase of the CEL and also to prevent coolant flow communication with the second volume V2. The upward elevation portion 40 may rise in elevation higher than the MCE. However, should coolant 16 be communicated to the bladder 14, a coolant drain 42 is provided to permit the discharge of coolant from the bladder. It is possible that coolant drain 42 may be in fluid communication with communication line 38 for any residual coolant in the second volume V2 to be sucked back to the first volume V1, for example if the communication line 38 is connected at the bottom surface 28. A pressure cap 44 is also disposed in fluid communication with the bladder 14 to control the pressure in the expansion tank 10.

Figure 2:
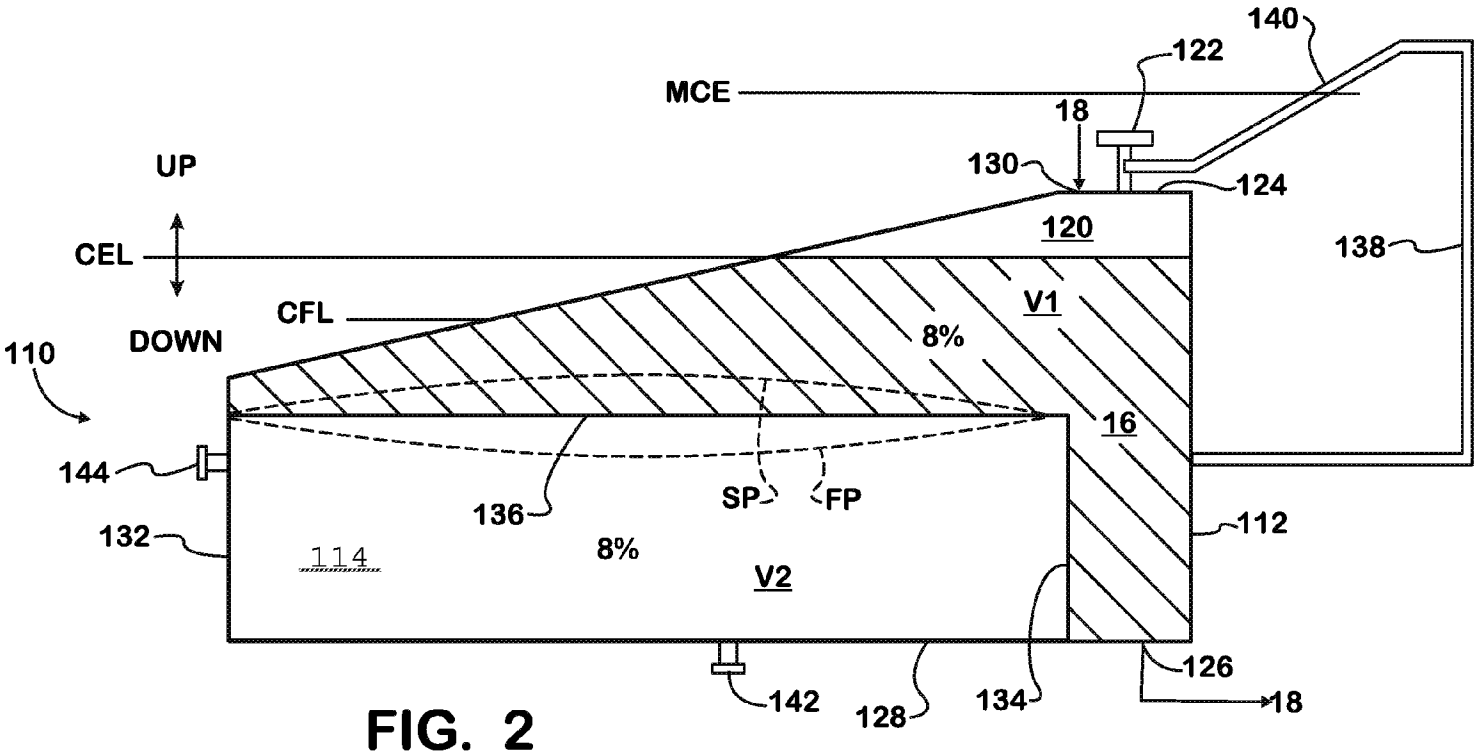
FIG. 2 is a schematic of a second embodiment of expansion tank for the vehicle cooling system.

Turning now to FIG. 2, a second embodiment of expansion tank is indicated generally at 110 and is generally similar in operation to the expansion tank 10. The expansion tank 110 has a tank body 112 with a first volume V1 of coolant 16, and a bladder 114 disposed in the tank body 112 having a second volume V2. The tank body 112 is generally truncated prism-shaped, however other shapes are possible. The first volume V1 is configured to receive the liquid coolant 16 of the cooling system 18. The cooling system 18 is associated with the engine (not shown) having a coolant fill level (CFL) and maximum coolant elevation (MCE). During operation of the cooling system 18, the CEL needs to be at least as high in elevation as the CFL of the engine.

The second volume V2 in the bladder 114 is configured to be filled with air. An upper volume 120 of the tank body 112 located above the CEL is also filled with air. It is possible that the second volume V2 and the upper volume 120 can be filled with a fluid other than air and coolant vapors.

A coolant cap 122 is disposed at a top surface 124 on the tank body 112. A coolant output 126 is disposed at a bottom surface 128 on the tank body 112 to fluidly communicate coolant 16 to the cooling system 18. One or more coolant inputs 130 fluidly communicate the coolant 16 from the cooling system 18 to the tank body 112.

In the expansion tank 110, the bladder 114 is located at a lower half portion 132 of the tank body 112 such that air is located beneath the CEL. At least a portion of the second volume V2 is at a lower elevation than the CEL.

In the expansion tank 110, the bladder 114 has at least one rigid wall 134 and at least one flexible membrane 136 that is operable to change the volume V2 of air. In the expansion tank 110, the bladder 114 is located at the bottom surface 128 of the tank body 112, the flexible membrane 136 has a generally horizontal orientation, and the rigid wall 134 has a generally vertical orientation, however other configurations of bladder 114 are possible.

Similar to the expansion tank 10, the membrane 136 has a first position, shown in dashed as FP, and having a generally convex shape with respect to the interior of the bladder 114. In position FP, the second volume V2 is decreased, the upper volume 20 is increased, and the CEL lowers.

When the engine starts up, the actuator 46 actuates the membrane 136 to deflect to a second position, shown in dashed as SP, and having a generally concave shape with respect to the interior of the bladder 114. In position SP, the second volume V2 is increased, the upper volume 120 is decreased, and the CEL rises.

A communicating line 138 communicates air between the upper volume 120 to the second volume V2. An upward elevation portion 140 that acts as a stop to prevent further coolant 16 communication along the communicating line 138. A coolant drain 142 and a pressure cap 144 are also in fluid communication with the bladder 114.

With the expansion tank 10, 110 having the moveable membrane 36, 136, the CEL elevation can be changed. When the CEL elevation can be raised higher, then the expansion tank 10, 110 can be positioned lower with respect to the other cooling system components 18.

What is claimed is:

1. An engine coolant system for a vehicle, the engine coolant system having a minimum desired coolant fill level, and the coolant system comprising:

an engine cooling system having a minimum desired Coolant Fill Level;

an expansion tank for the cooling system using a liquid coolant;

a tank body of the expansion tank defining a first volume containing coolant and defining an upper volume of air;

wherein the tank body defines a continuous volume at least a portion of which extends above and below the Coolant Fill Level;

a coolant outlet to communicate coolant away from the tank body;

a coolant inlet to communicate coolant into the tank body;

a bladder defining a second volume containing air within the bladder, wherein the bladder includes a flexible membrane moveable between a first position to decrease the second volume and increase the upper volume, and a second position to increase the second volume and decrease the upper volume, wherein the upper volume of air is located within the tank body at a different location than the first volume of coolant and the second volume of air, wherein the upper volume of air is in fluid communication with the second volume of air;

an actuator for selectively controlling the membrane movement between the first and second position to maintain the coolant at a level above the Coolant Fill Level during operation of the vehicle; and a communication line in fluid communication between the upper volume and the second volume.

2. The engine coolant system of claim 1 wherein the expansion tank has coolant in the first volume which forms a coolant elevation level.

3. The engine coolant system of claim 2 wherein the coolant elevation level rises in the expansion tank when the bladder is in the second position.

4. The engine coolant system of claim 3 wherein the second volume is one of at least partially equal to or at least partially below the coolant elevation level in the expansion tank.

5. The engine coolant system of claim 1 wherein the flexible membrane in the expansion tank is one of generally horizontally oriented and generally vertically oriented.

6. The engine coolant system of claim 1 wherein when the flexible membrane in the expansion tank is in the first position, air from the second volume is communicated to the upper volume.

7. The engine coolant system of claim 1 wherein when the flexible membrane in the expansion tank is in the second position, air from the upper volume is communicated to the second volume.

8. The engine coolant system of claim 1 wherein the expansion tank further comprises a coolant drain in fluid communication with the bladder.

9. The engine coolant system of claim 1 wherein movement of the flexible membrane in the expansion tank to the second position is actuated when one of the engine is started or the engine reaches a pre-determined temperature.

* * * * *